US006378411B1

(12) United States Patent
Koseki

(10) Patent No.: US 6,378,411 B1
(45) Date of Patent: Apr. 30, 2002

(54) WORKING EQUIPMENT AND A CONTROL SYSTEM THEREFOR

(75) Inventor: Mitsuhiro Koseki, Tokyo (JP)

(73) Assignee: Kabushiki Kaisha F.F.C., Tokyo (JP)

( * ) Notice: Subject to any disclaimer, the term of this patent is extended or adjusted under 35 U.S.C. 154(b) by 0 days.

(21) Appl. No.: 09/656,083

(22) Filed: Sep. 6, 2000

(30) Foreign Application Priority Data

Sep. 6, 1999 (JP) ..... 11-251591

(51) Int. Cl.[7] ..... F15B 9/03
(52) U.S. Cl. ..... 91/363 R; 60/390
(58) Field of Search ..... 91/363 R; 60/388, 60/390

(56) References Cited

U.S. PATENT DOCUMENTS

| | | | | |
|---|---|---|---|---|
| 3,505,929 A | * | 4/1970 | Coppola et al. | 91/363 R |
| 3,559,534 A | * | 2/1971 | Munro | 91/363 R |
| 4,235,156 A | * | 11/1980 | Olsen | 91/363 R |
| 5,826,483 A | * | 10/1998 | Koseki | 91/361 |

FOREIGN PATENT DOCUMENTS

| | | |
|---|---|---|
| DE | 2425390 | 12/1975 |
| EP | 723840 | 7/1996 |
| FR | 1256086 | 6/1961 |
| FR | 2148006 | 3/1973 |
| JP | 58047830 | 3/1983 |
| JP | 61290127 | 12/1986 |
| JP | 10-219751 | 8/1998 |

* cited by examiner

*Primary Examiner*—Edward K. Look
*Assistant Examiner*—Igor Kershteyn
(74) *Attorney, Agent, or Firm*—Leydig, Voit, & Mayer, Ltd.

(57) ABSTRACT

Operating side link members corresponding to working side link members of a working device are provided in a device for operating working equipment. Rotation of the working side link members is detected by a rotation sensor. A motor is driven in response to a signal from the rotation sensor. A differential detecting portion has a working side movable portion driven both in a forward direction and a reverse direction by the motor, an operating side movable portion that is shiftable both in the forward direction and the reverse direction within a range from a neutral position to the working side movable portion, and a differential sensor for detecting a relative shift from the neutral position of the operating side movable portion to the working side movable portion. An operation transmitter is disposed between the operating side link members and the operating side movable portion for mechanically transmitting the rotation of the operating side link members and for shifting the operating side movable portion in response to the rotation of the operating side link members. The driving device is controlled by a control section in response to the signals from the differential sensor.

15 Claims, 10 Drawing Sheets

WORKING EQUIPMENT AND A CONTROL SYSTEM THEREFOR

BACKGROUND OF THE INVENTION

1. Field of the Invention

The present invention relates to working equipment in which a working device having a plurality of link members on the working side are operated by an operating unit having similar link members, for heavy machinery such as hydraulic excavators, industrial robots, medical treatment devices and devices for handling dangerous articles such as radioactive substances or the like and to a control system used for the working equipment.

2. Description of the Related Art

In conventional hydraulic excavators, there are provided two operating levers for controlling an actuator for a working device. These operating levers are each operable in four directions, i.e., in a total of eight directions. In a hydraulic excavator, the boom, arm, bucket and pivoting body pivot in two directions each, making a total of eight directions. The operating directions of the boom, arm, bucket and pivoting body correspond to the operating directions of the operating lever mentioned above.

However, in a conventional hydraulic excavator as described above, the operating directions of the boom, arm, bucket and pivoting body differ from those of the operating lever. A problem is therefore that great skill is required to intuitively comprehend the relationship between these operating and working directions and ensure smooth operation of the heavy equipment. Another problem is that considerable differences are caused in the progress of work by the personal ability of operators such as the degree of skill, thus exerting a large influence on the period of work as a whole.

SUMMARY OF THE INVENTION

The present invention was developed to solve the problems as described above, and in directed to providing working equipment and an operating system therefor which permit smooth operation without requiring great skill.

To this end, according to one aspect of the present invention, there is provided working equipment comprising: a working device having a plurality of rotatably coupled working side link members; a driving device for rotating the plurality of working side link members, respectively; an operating device having a plurality of operating side link members rotatably coupled corresponding to the working side link members, respectively; a rotation sensor for detecting rotation of the working side link members; a motor driven in response to a signal from the rotation sensor; a differential detecting portion having a working side movable portion driven both in a forward direction and a reverse direction by the motor, an operating side movable portion that is shiftable both in the forward direction and the reverse direction within a predetermined range from a neutral position to the working side movable portion, and a differential sensor for detecting a relative shift from the neutral position of the operating side movable portion to the working side movable portion; an operation transmitting means disposed between the operating side link members and the operating side movable portion for mechanically transmitting the rotation of the operating side link members and for shifting the operating side movable portion in response to the rotation of the operating side link members; and a control section for controlling the driving device in response to the signal from the differential sensor, wherein the working side link members are rotated by the driving device in response to the rotation of the associated operating side link members and the working side movable portion is driven by the motor in a direction in which the operating side movable portion is returned to a relatively neutral position.

According to another aspect of the present invention, there is provided an operating system for working equipment including a working device having a plurality of rotatably coupled working side link members and a driving device for rotating the plurality of working side link members, respectively, comprising: an operating device having a plurality of operating side link members rotatably coupled corresponding to the working side link members, respectively; a rotation sensor for detecting rotation of the working side link members; a motor driven in response to a signal from the rotation sensor; a differential detecting portion having a working side movable portion driven both in a forward direction and a reverse direction by the motor, an operating side movable portion that is shiftable both in the forward direction and the reverse direction within a predetermined range from a neutral position to the working side movable portion, and a differential sensor for detecting a relative shift from the neutral position of the operating side movable portion to the working side movable portion; an operation transmitting means disposed between the operating side link members and the operating side movable portion for mechanically transmitting the rotation of the operating side link members and for shifting the operating side movable portion in response to the rotation of the operating side link members; and a control section for controlling the driving device in response to the signal from the differential sensor, wherein the working side movable portion is driven by the motor in a direction in which the operating side movable portion is returned to a relatively neutral position.

DETAILED DESCRIPTION OF THE PREFERRED EMBODIMENTS

An embodiment of the present invention will now be described.

First Embodiment

Figure 1:
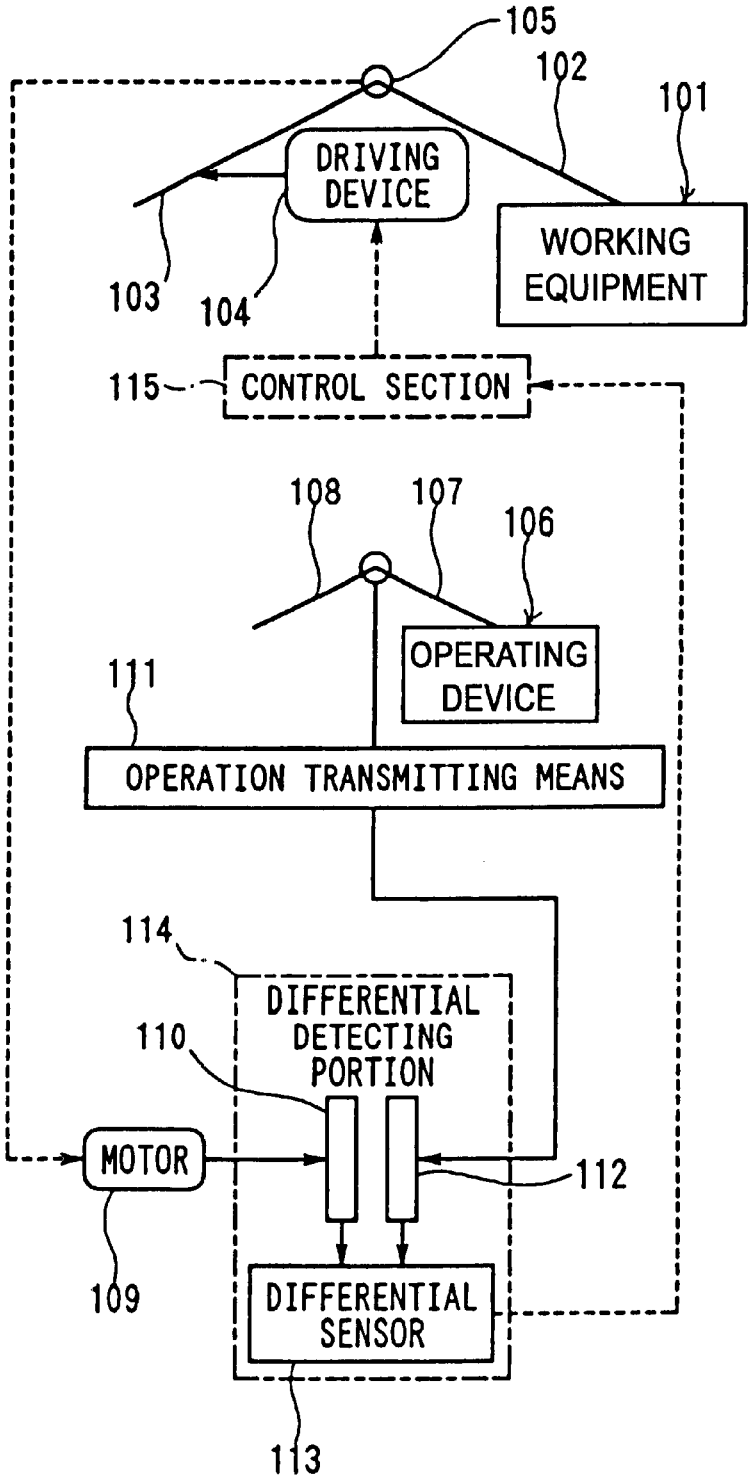
FIG. 1 is an illustration of, in a partial block diagram, the operational theory of the working equipment in accordance with a first embodiment of the present invention.

FIG. 1 is a partial block diagram showing the operational theory of the working equipment in accordance with a first embodiment of the present invention. Although this invention may be used for working equipment having link mechanisms with a plurality of articulations, a link mechanism having a single articulation will now be described for the sake of simplification.

In FIG. 1, the working equipment 101 for performing the actual work has first and second working side link members 102 and 103 connected rotatably with each other. The second working side link member 103 is rotated relative to the first working side link member 102 by a driving device 104. If the driving device 104 is of a hydraulic type, a hydraulic motor or a hydraulic cylinder is used, and if the driving device is electrically powered working equipment, an electric drive motor is used and in some cases, a linear motor or the like is used. The rotation (the amount of rotation and direction of rotation) of the second working side link member 103 relative to the first working side link member 102 is detected by a rotation sensor 105.

An operating device 106 operated by the operator has first and second operating side link members 107 and 108 connected rotatably to each other and correspond to the associated first and second working side link members 102 and 103, respectively. In the case where the size of the working side link members 102 and 103 is large, it is possible to reduce the size of the operating side link members 107 and 108 to a size such that they are easy to handle.

A motor 109 is connected to the rotation sensor 105. For instance, a servomotor is used as the motor 109. A working side movable portion 110 is driven both in a forward direction and a reverse direction by the motor 109. The rotation (the amount of rotation and direction of rotation) of the operating side link member 108 relative to the first operating side link member 107 is mechanically transmitted to an operating side movable portion 112 through an operation transmitting means 111.

Accordingly, the working side movable portion 110 shifts in correspondence with the rotation of the working side link member 103, whereas the operating side movable portion 112 shifts in correspondence with the rotation of the operating side link member 108. The operating side movable portion 112 is shiftable both in the forward direction and the reverse direction within a predetermined range from a neutral position relative to the working side movable portion 110. The shifts of these working side and operating side movable portions 110 and 112 may be shifts in the circumferential direction by rotational operations or may be shifts by linear operations. Also, the working side movable portion 112 is shifted by means of the motor 109 but the shift of the working side movable portion 112 from the operating side is limited by means of the motor 109.

The relative shift of the operating side movable portion 112 to the working side movable portion 110 from the neutral position is detected by means of a differential sensor 113. Namely, the differential sensor 113 detects the differential movement between the operating side link member 108 and the working side link member 103. A differential detecting portion 114 is composed of the working side movable portion 110, the operating side movable portion 112 and the differential sensor 113. A control section 115 controls the driving device 104 in response to the signal from the differential sensor 113.

The operation will now be described. First of all, when the second operating side link member 108 is rotated by the operator, this rotation is transmitted to the operating side movable portion 112 through the operation transmitting means 111. When the operating side link member 108 is stopped, the operating side movable portion 112 is located in the neutral position relative to the working side movable portion 110. However, when the working side link member 108 is rotated, the operating side movable portion 112 is shifted in the corresponding direction from the neutral position.

At this time, since the working side link member 103 has not yet rotated, the working side movable portion 110 is stopped. Accordingly, the operating side movable portion 112 is shifted relative to the working side movable portion 110 and this relative shift is detected by means of the differential sensor 113. Thereafter, the signal is outputted from the differential sensor 113 to the control section 115. The driving device 104 is controlled by means of the control section 115 in response to this signal. Namely, when the second operating side link member 108 is rotated, the second working side link member 103 is rotated in the same direction by the driving device 104 with a slight delay.

Such a rotation of the second working side link member 103 is detected by the rotation sensor 105, and the motor 109 is driven so that the working side movable portion 110 is shifted relative to the working side movable portion 112 in the direction that the operating side movable portion 112 is shifted back to the neutral position. Namely, the working side movable portion 110 is shifted so as to follow the operating side movable portion 112. Accordingly, when the second operating side link member 108 is continuously rotated, the operating side and working side movable portions 112 and 110 are continuously shifted in the same direction so that the second working side link member 103 is continuously rotated.

Also, when the rotation of the second operating side link member 108 is stopped, the operating side movable portion 112 is returned back to the neutral position relative to the working side movable portion 110. The rotation of the second working side link member 103 is also stopped.

In the foregoing example, a link mechanism having a single articulation has been described. Also for the link mechanism having a plurality of articulations, the numbers of the rotation sensors 105, the motors 109 and the differential detecting portion 114 are increased so that the rotations of the operating side link members at the respective articulations are transmitted to the associated operating side movable portion through the operation transmitting means. Thus, it is possible to cause the associated working side link members to follow with high precision in accordance with the operation of the operating side link members.

Accordingly, although the present invention may be applied to working equipment having a link mechanism with single articulation as shown in FIG. 1, the invention may be particularly suitable for working equipment having a link mechanism in which a plurality of articulations are arranged in series.

Second Embodiment

Figure 2:
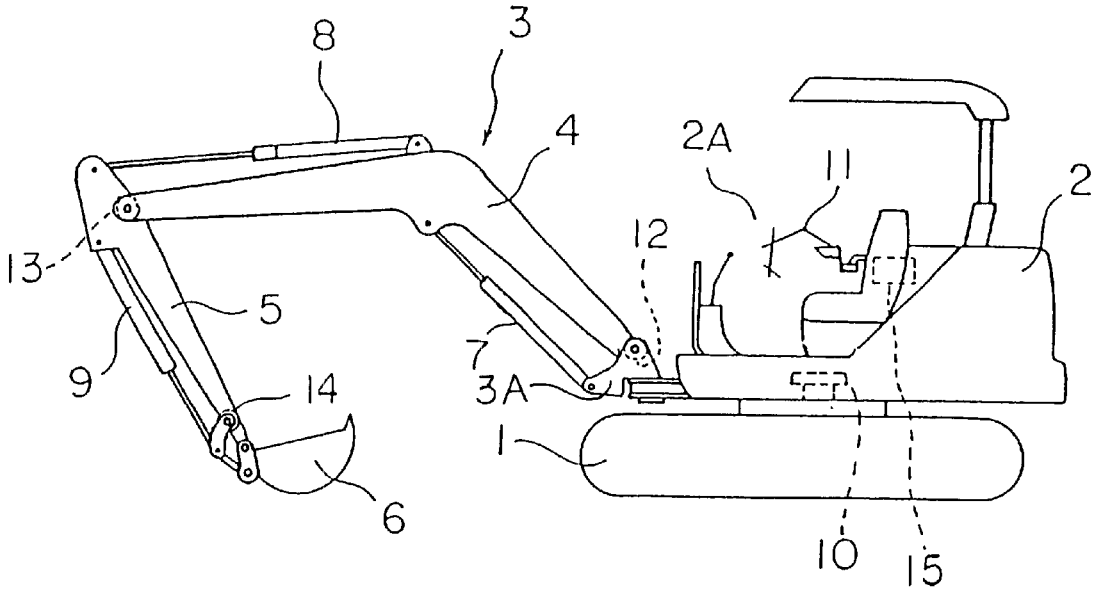
FIG. 2 is a schematic structural view showing a hydraulic excavator in accordance with a second embodiment of the present invention.

The case where the present invention is applied to a hydraulic excavator that is the hydraulic working equipment will now be described. FIG. 2 is a schematic view showing an overview of the hydraulic excavator in accordance with a second embodiment of the present invention. In FIG. 2, an upper pivoting body 2 having an operator's cab 2A is pivotally provided on a lower propulsion body 1. A working device 3 is mounted on this upper pivoting body 2. The working device 3 has a boom coupling member 3A, a boom 4 coupled rotatably with this boom coupling member 3A, an arm 5 coupled rotatably with this boom 4 and a bucket 6 coupled rotatably with this arm 5.

Here, regarding the working device 3 as the working side link mechanism, the boom coupling member 3A, the boom 4, the arm 5 and the bucket 6 correspond to the working side link members, respectively.

A boom cylinder 7 is provided between the boom coupling member 3A and the boom 4, an arm cylinder 8 is provided between the boom 4 and the arm 5 and a bucket cylinder 9 is provided between the arm 5 and the bucket 6, respectively. Hydraulic cylinders are used as these cylinders 7, 8 and 9. The upper pivoting body 2 is pivotal to the lower repulsion body 1 by a pivoting motor 10 that is a hydraulic motor. An operating device 11 that constitutes the link mechanism on the operating side with a desired reduction ratio to the link mechanism of the working device 3 is provided in the operator cab 2A.

A boom sensor 12 that is the rotation sensor for detecting rotation of the boom 4 is provided at a proximal end portion of the boom 4. An arm sensor 13 that is the rotation sensor for detecting the rotation of the arm 5 is provided at the joint portion between the boom 4 and the arm 5. A bucket sensor 14 that is the rotation sensor for detecting the rotation of the bucket 6 is provided at a part of the link mechanism for rotating the bucket 6. Well known rotation sensors such as potentiometers for outputting electric signals in response to the rotational conditions may be suitably selected and used as these sensors 12 to 14. Also, encoders may be used for detecting absolute rotational positions.

A differential unit 15 for operating the working device 3 is installed in a suitable position on the upper pivoting body 2. The respective sensors 12 to 14 and the differential unit 15 are electrically connected through wiring (not shown).

Figure 3:
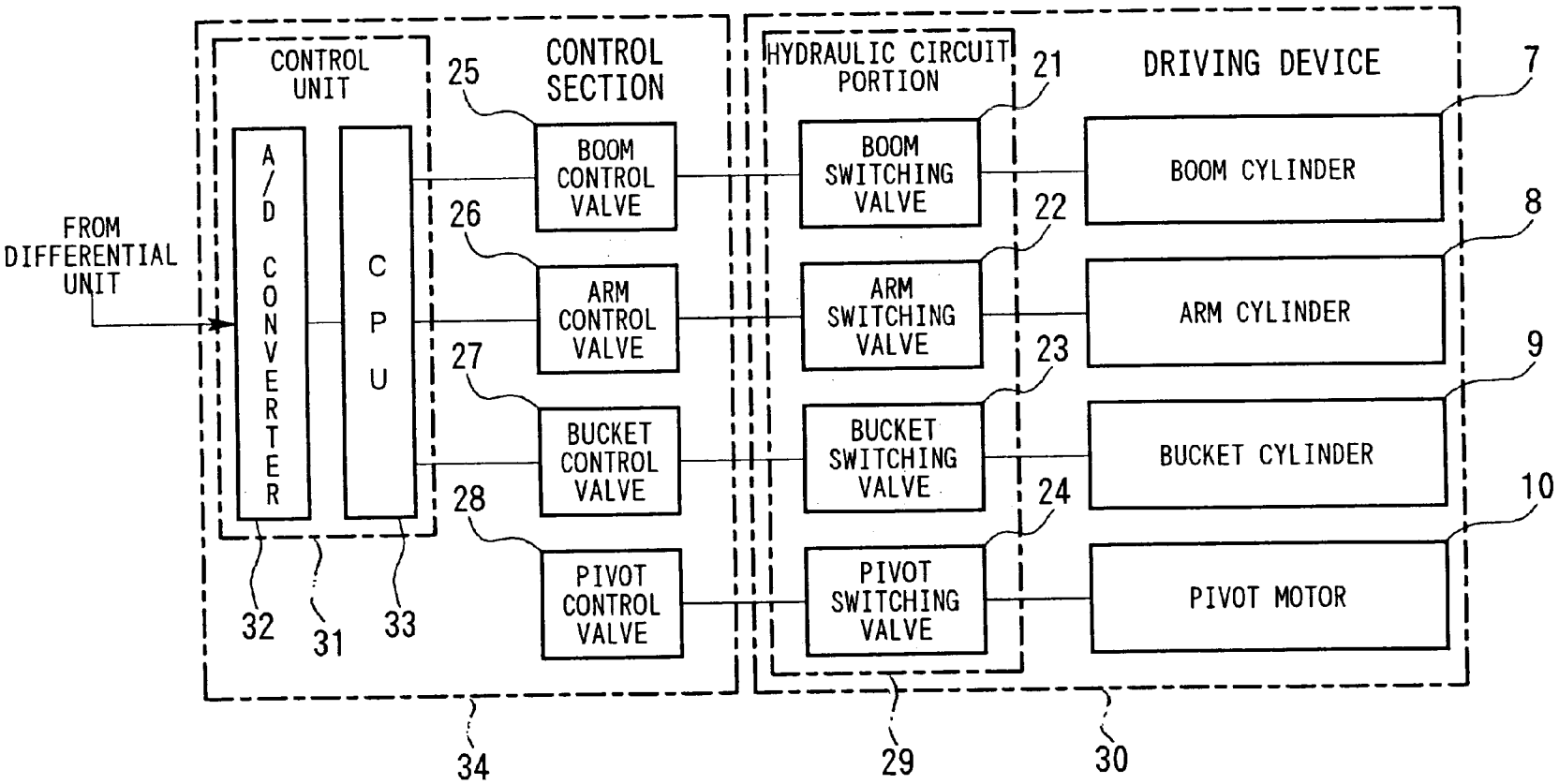
FIG. 3 is a schematic block diagram showing primary portions of the hydraulic excavator shown in FIG. 2.

FIG. 3 is a schematic block diagram showing primary portions of the hydraulic excavator shown in FIG. 2. In FIG. 3, switching valves 21 to 24 for switching operational directions of the respective cylinders 7 to 9 and the pivoting motor 10 are connected to the cylinders and motor, respectively. The respective switching valves 21 to 24 are controlled by means of the associated control valves 25 to 28. Electromagnetic proportional valves are used as the boom control valve 25, the arm control valve 26 and the bucket control valve 27.

It goes without saying that reservoirs, hydraulic pumps and the like (not shown) are provided in the hydraulic circuit portion 29 having the above-described switching valves 21 to 24. It is also possible to use a hydraulic circuit portion for a conventional hydraulic excavator. Accordingly, a variety of modifications may be made as to the details of the circuit structure. The driving device 30 in this second embodiment has hydraulic cylinders 7 to 9, the pivoting motor 10 and the hydraulic circuit portion 29.

The boom control valve 25, the arm control valve 26 and the bucket control valve 27 are controlled in accordance with signals from the control unit 31. The control unit 31 is provided with an A/D converter 32 for converting an analog signal from the differential unit 15 to a digital signal and a CPU 33 for processing the signal from the A/D converter 32 and outputting the signal to the control valves 25 to 27. The control section 34 has the control valves 25 to 28 and the control unit 31.

Figure 4:
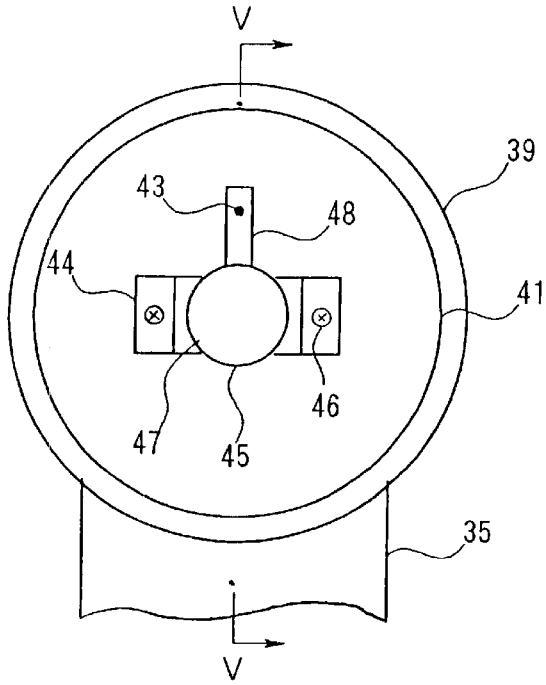
FIG. 4 is a frontal view showing primary portions of a differential unit of the hydraulic excavator shown in FIG. 2.
Figure 5:
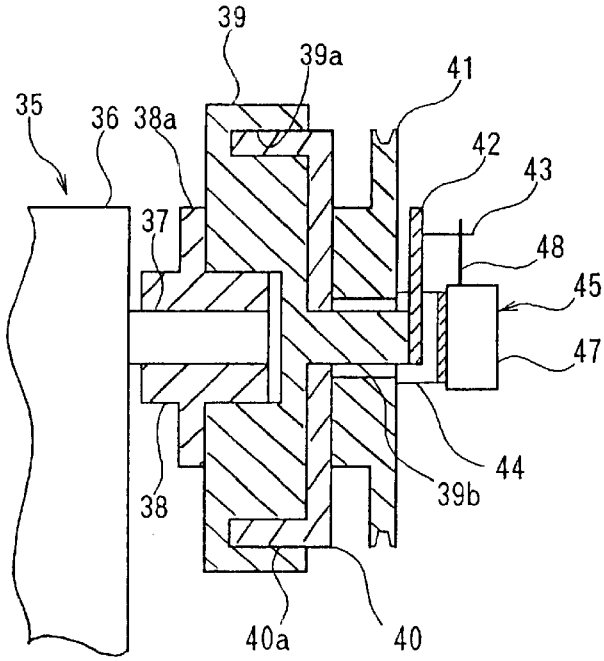
FIG. 5 is a cross-sectional view taken along the line V—V of FIG. 4.

Subsequently, FIG. 4 is a frontal view showing primary portions of the differential unit 15 of the hydraulic excavator shown in FIG. 2, and FIG. 5 is a cross-sectional view taken along the line V—V of FIG. 4. A servomotor 35 is driven in accordance with a signal from any of the boom sensor 12, the arm sensor 13 and the bucket sensor 14. The servomotor 35 has a motor body 36 and a rotary shaft 37 rotated by this motor body 36. A flange member 38 rotated together with the rotary shaft 37 is fixed to the rotary shaft 37. A flange portion 38*a* is formed on the flange member 38.

A working side rotational piece 39 that is the working side movable portion rotated together with the flange member 38 is fixed to the flange member 38. The working side rotational piece 39 is fixed to the flange portion 38*a* by screws (not shown). Also, an arcuate engagement groove 39*a* and a shaft portion 39*b* are provided in the working side rotational piece 39.

An operating side rotational piece 40 that is the operating side movable portion is used in combination with the working side rotational piece 39. The operating side rotational piece 40 may be rotated both in the forward and reverse directions within a predetermined range (angle) about the same axis as that of the working side rotational piece 39 relative thereto. An arcuate engagement projection 40*a* that is inserted into the engagement groove 39*a* and moves within the engagement groove 39*a* in accordance with the relative rotation of the operating side rotational piece 40 is provided in the operating side rotational piece 40.

A differential unit side pulley 41 is fixed to the operating side rotational piece 40 by screws (not shown). The differential unit side pulley 41 is rotated together with the operating side rotational piece 40 by operating the operating device 11. A shaft portion 39*b* of the working side rotational piece 39 passes through central portions of the operating side rotational piece 40 and the differential unit side pulley 41. Also, the rotary shaft 37, the flange member 38, the working side rotational piece 39, the engagement groove 39*a*, the shaft portion 39*b*, the operating side rotational piece 40, the engagement projection 40*a* and the differential unit side pulley 41 are disposed coaxially about the same axis, respectively.

A pin support plate 42 that is rotated together with the working side rotational piece 39 is fixed to a distal end portion of the shaft portion 39*b*. A pin 43 is implanted in the pin support plate 42. A differential sensor 45 is mounted through a seat 44 on a side surface of the differential unit side pulley 41. The seat 44 is fixed to the differential unit side pulley 41 by a plurality of screws 46.

The differential sensor 45 has a sensor body 47 fixed to the seat 44 and a swing piece 48 pivotally provided on the sensor body 47. The differential detecting portion in accordance with this second embodiment has the working side rotational piece 39, the operating side rotational piece 40, the pin support plate 42, the pin 43, the seat 44 and the differential sensor 45. The internal structures of the motor body 36 and the sensor body 47 are not shown in any drawings. The pin 43 passes through the swing piece 48 rotatably.

The differential sensor 45 is mounted on the operating side rotational piece 40 through the seat 44 and the differential unit side pulley 41 and rotated together with the operating side rotational piece 40. In contrast, since the pin 43 is shifted by the rotation of the working side rotational piece 39, when the operating side rotational piece 40 is rotated and shifted relative to the working side rotational piece 39, the swing piece 48 is swung relative to the sensor body 47. Thus, an analog electric signal is outputted from the differential sensor 45 to the control unit 31 of the control section 34.

Figure 6:
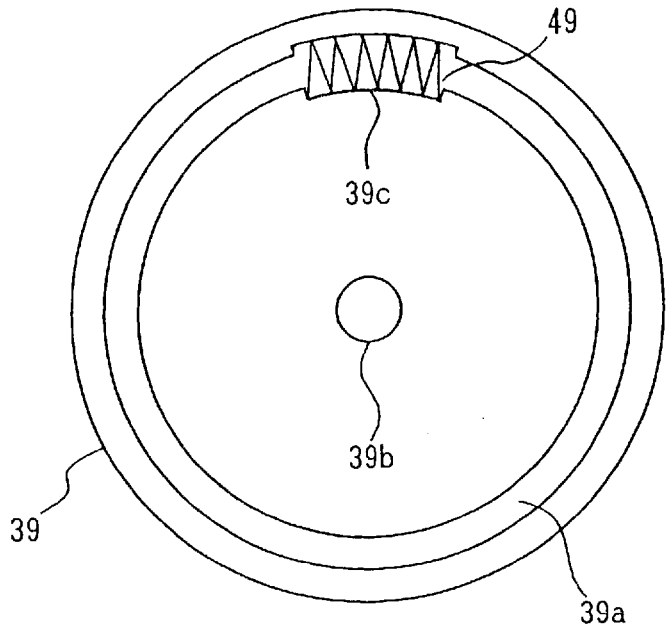
FIG. 6 is a frontal view showing a rotary piece on the working side shown in FIG. 5.
Figure 7:
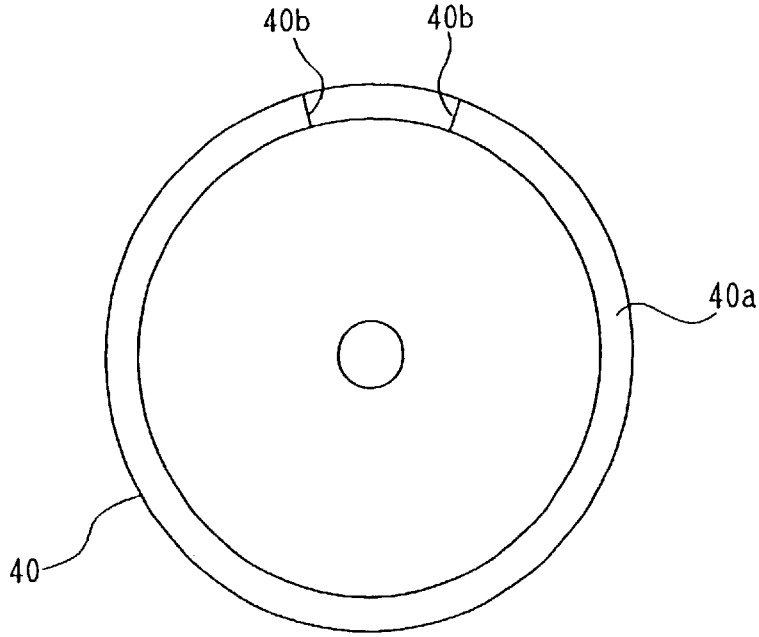
FIG. 7 is a frontal view showing a rotary piece on the operating side shown in FIG. 5.

FIG. 6 is a frontal view showing the working side rotational piece 39 shown in FIG. 5. FIG. 7 is a frontal view showing the operating side rotational piece 40 shown in FIG. 5. Further, FIG. 6 is a view of the working side rotational piece 39 as viewed from the right side of FIG. 5 and FIG. 7 is a view of the operating side rotational piece 40 as viewed from the left side of FIG. 5.

An arcuate spring receiving portion 39*c* is provided by expanding the groove width in a part of the engagement groove 39*a* of the working side rotational piece 39. A return spring 49 for biasing the operating side rotational piece 40 back to a neutral position is received in the spring receiving portion 39*c*. A pair of contact portions 40*b* for contact with both end portions of the return spring 49 are provided in the engagement projection 40*a* of the operating side rotational piece 40. With such a structure, the relative rotational range of the operating side rotational piece 40 to the working side rotational piece 39 is restricted to a predetermined angular range.

Further, three sets of devices shown in FIGS. 4 to 7 and corresponding to the boom 4, the arm 5 and the bucket 6, respectively, are provided in the differential unit 15.

Figure 8:
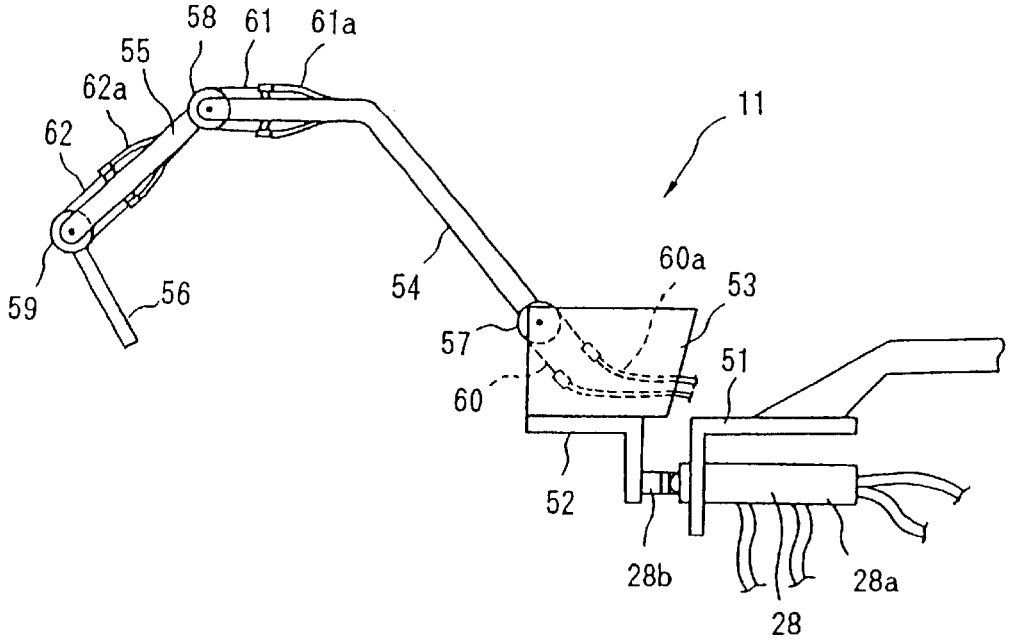
FIG. 8 is a side elevational view showing the operating unit shown in FIG. 2.

Next, FIG. 8 is a side elevational view showing the operating device 11 shown in FIG. 2. In FIG. 8, a pivot control valve 28 for the pivot motor 10 is mounted on a fixed member 51 fixed to the operator's cab 2A. The pivot control valve 28 has a valve body 28*a* fixed to the fixed member 51 and a swingable valve operating lever 28*b* provided in this valve body 28*a*. A movable support member 52 is fixed to the valve operating lever 28*b*. This movable support member 52 is rotatable to the right and left sides in the horizontal direction together with the valve operating lever 28*b* relative to the fixed member 51.

An operating device base 53 is fixed onto the movable support member 52. A proximal end portion of a boom lever 54 is rotatably connected to this operating device base 53. An arm lever 55 is rotatably connected to a distal end portion of this boom lever 54. Further, a bucket lever 56 is rotatably connected to a distal end portion of the arm lever 55.

The bucket lever 56 also serves as a grip for the operating device 11 and is formed into a shape such that the operator may readily grip it. Also, it is possible to mount an electric switch, a safety switch or the like onto the bucket lever 56 in order to operate auxiliary equipment.

Here regarding the operating device 11 as the link mechanism on the operating side, the operating device base 53, the boom lever 54, the arm lever 55 and the bucket lever 56 correspond to the operating side link members, respectively.

A boom lever pulley 57, an arm lever pulley 58 and a bucket lever pulley 59 that rotate together with the respective levers 54 to 56 are fixed to the proximal end portions of the respective levers 54 to 56. Parts of a loop-like boom wire 60, a loop-like arm wire 61 and a loop-like bucket wire 62 are laid around the outer circumferences of the respective lever pulleys 57 to 59. Each wire 60 to 62 is fixed to one position on the circumference of each lever pulley 57 to 59 by fastening, for example, a retainer screw (not shown).

Also, the respective wires 60 to 62 are led to the vicinity of the respective lever pulleys 57 to 59 under the condition that they are slidably inserted into wire tubes 60*a*, 61*a* and 62*a*. One end portion of each wire tube 60*a*, 61*a*, 62*a* is fixed to the operating device base 53, the boom lever 54 and arm lever 55, respectively.

Figure 9:
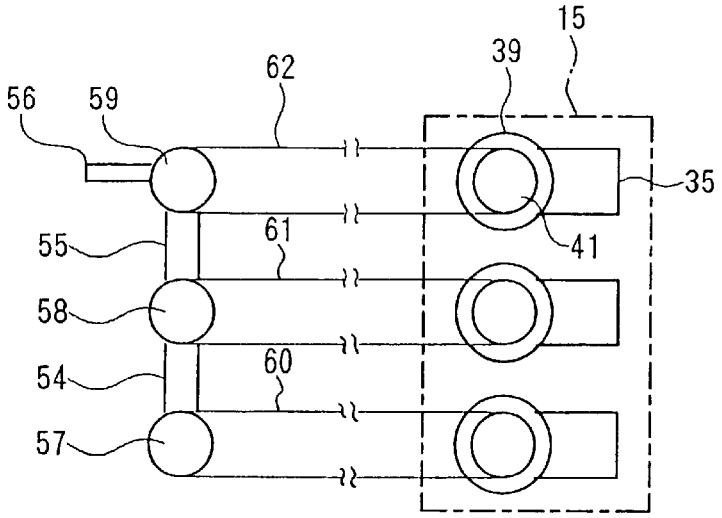
FIG. 9 is a schematic illustration of a connected condition between the operating units and the differential units.

FIG. 9 is a schematic illustration of the connected condition between the operating device 11 and the differential unit 15. As described above, three sets of units obtained by combination of the differential detecting portion and the servomotor 35 are provided in the differential unit 15. The parts of the wires 60 to 62 led by the wire tubes 60*a*, 61*a* and 62*a* shown in FIG. 8 are wound around the differential unit side pulleys 41 of the respective units. Each of the wires 60 to 62 are fixed to one position on the circumference of each differential unit side pulley 41 by fastening the retainer screws (not shown), for example.

Accordingly, when the respective levers 54 to 56 of the operating device 11 are rotated and the associated lever pulleys 57 to 59 are rotated, the wires 60 to 62 are recirculated and the associated differential unit side pulley 41 is rotated. The operation transmitting means in accordance with this second embodiment has the lever pulleys 57 to 59, the wires 60 to 62, the wire tubes 60*a*, 61*a* and 62*a* and the differential unit side pulley 41.

The operation will now be described. The operator riding in the operator's cab 2A grips the bucket lever 56 of the operating device 11 and moves the bucket lever 56 so as to move the bucket 6 while observing the working site and the bucket 6. Thus, the respective articulation portions of the operating device 11 are rotated.

For example, if the boom lever 54 is rotated in the counterclockwise direction (downwardly) in FIG. 8, the boom lever pulley 57 is rotated in the same way together with the boom lever 54. Since the boom wire 60 is fixed to the boom lever pulley 57, the boom wire 60 is circulated within the wire tube 60*a* by the rotation of the boom lever pulley 57 and the associated differential unit side pulley 41 is rotated in synchronism therewith.

When the differential unit side pulley 41 is rotated, the operating side rotational piece 40 is rotated together with the pulley. At this time, since the boom 4 has not yet been rotated and the amount of rotation is zero in the signal from the boom sensor 12, the working side rotational piece 39 is kept stopped. Accordingly, the operating side rotational piece 40 is rotated relatively in one direction from the neutral position to the working side rotational piece 39.

At this time, the engagement projection 40*a* is slid within the engagement groove 39*a* and the return spring 49 is compressed by one of the contact portions 40*b*. The relative rotational angle of the operating side rotational piece 40 to the working side operational piece 39 is restricted by the compression range of the return spring 49. Also, although the working side rotational piece 39 is rotated by means of the servomotor 35, the forcible shift of the working side rotational piece 39 from the operating side beyond the compression range of the return spring 49 is restricted by means of the servomotor 35.

When the operating side rotational piece 40 is thus rotated relative to the working side rotational piece 39, the swing piece 48 is swung by means of the pin 43 so that the signal is outputted from the differential sensor 45 to the control unit 31. The signal from the differential sensor 45 is converted to a digital signal by the A/D converter 32, and further, after the signal is processed in calculation through the CPU 33, the signal is outputted from the control unit 31 to the boom control valve 25.

The boom control valve 25 is operated in accordance with the signal from the control unit 31 and the boom switching valve 21 is controlled by the boom control valve 25. Accordingly, when the boom lever 54 is rotated, the boom 4 is rotated in the same manner with a slight delay from the operation.

Such a rotation of the boom 4 is detected by the boom sensor 12, the associated servomotor 35 is thus driven, and the working side rotational piece 39 is rotated in the direction in which the operating side rotational piece 40 is returned back to the neutral position. Namely, when the operating side rotational piece 40 is rotated by the operation of the operating device 11, the working side rotational piece 39 is rotated by means of the servomotor 35 so as to follow the piece 40 in the same direction. Accordingly, when the boom lever 54 is continuously rotated, the operating side rotational piece 40 and the working side rotational piece 39 are continuously rotated, and the boom 4 is continuously rotated.

Also, if the rotation of the boom lever 54 is stopped, the working side rotation piece 39 reaches the operating side rotational piece 40, the operating side rotational piece 40 is returned back to the neutral position. The signal from the differential sensor 45 is not outputted (or the signal of the differential zero is outputted), and the rotation of the boom 4 is also stopped. Incidentally, in the case where the boom lever 54 is operated in the reverse direction, the opposite operation to that described above is performed. Also, the arm 5 and the bucket 6 are operated in the same way as for the boom 4. The rotational direction of each lever 54 to 56 and the rotational direction of the associated boom 4, arm 5 and bucket 6 are set to be the same in advance.

Next, the swivel operation will be described. When the operator rotates the operating device 11 as a whole in a desired direction while gripping the bucket lever 56, the valve operating lever 28*b* of the pivot control valve 28 is directly operated, and the upper pivoting body 2 as a whole is swiveled in the same direction. Accordingly, during the rotation of the operating device 11 in the pivot direction, the upper pivoting body 2 is swiveled in the same direction. When the rotation of the operating device 11 is stopped, the pivot motion of the upper pivoting body 2 is also stopped.

Thus, since the link mechanism of the working device 3 may be smoothly operated while following the link mechanism of the operating device 11, the operator may readily operate the operating device 11 with a similar feeling to directly move the working device 3. Also, since the link mechanism of the operating device 11 may automatically follow at a minimum distance if the bucket lever 56 is moved, it is unnecessary to consider the individual angle of each link. Accordingly, it is possible to enhance the working efficiency without special skills and it is possible to considerably reduce the working period as a whole.

Further, since the respective link members of the working device 3 and the operating device 11 correspond to each other in a one-to-one relation, it is unnecessary to consider the relative velocity of the arm 5 to the operation of the boom 4, for example, and the relative velocity shift and the device structure may be simplified. That is to say, since the distribution of working oil to the respective hydraulic cylinders 7 to 9 and the pivot motor 10 is automatically performed, it is possible to dispense with the complicated control with the distributor, and it is possible to considerably reduce the cost by utilizing the output of the pump provided in the hydraulic circuit portion 29 at maximum. Also, it is easy to mount the operating system onto known hydraulic working equipment and to perform the maintenance therefor.

Further, it is preferable that the feed of the signal from each sensor 12 to 14 to the servomotor 35 is performed by arranging the lead lines suitably but it is possible to perform that in a wireless manner signal transmission. It is possible to prevent a breakdown due to cuts or the like of the lead lines.

Also, in the second embodiment, the operation of the three hydraulic cylinders 7 to 9 and the pivot motor 10 has been described. However, for instance, this invention may be applied to the case where the boom 4 is swung and the boom 4 is rotated about the axis extending in the right and left directions of FIG. 2.

Further, it is possible to provide two sets of the working devices and operating devices, respectively, so that they may be steered by both hands. In this case, if the above-described operating system is used, it is sufficient only to increase the number of similar structures to thereby facilitate the addition of the sets of the devices.

Furthermore, in the second embodiment, the operation of the pivot control valve 28 is performed by means of the operating device 11. However, it is sufficient to operate the pivot control valve 24 by providing discrete levers or pedals on the foot side of the operator's cab 2A and operating the pedals by foot.

Also, in the second embodiment, the operation transmitting means using the pulleys and the wires is shown. However, an operation transmitting means using toothed pulleys and toothed belts or an operation transmitting means using a chain and sprocket assembly may be used.

Further, in the second embodiment, although the invention is applied to hydraulic excavators, particularly, a hydraulic backhoe, this invention may be applied to various hydraulic equipment such as truck backhoes, jumbo breakers, crushers, clamshells, hydraulic forks (scissors), hydraulic vibro machines. Also, it is possible to mount various attachments instead of the bucket.

Furthermore, it is possible to apply this invention to fixed working equipment having no lower propulsion body, and it is possible to provide the operating device outside the working equipment body. For instance, even in cases where the working device for performing work at the ocean bottom, lake bottom, river bottom and the bottom of deep pits is operated by a discrete operating device, the present invention may be applied thereto. In such cases, for example, wiring from the control unit 31 to the control valves 25 to 27 and wiring from the rotation sensors 12 to 14 to the servomotor 35 are extended to be distributed to the working side and the operating side. Furthermore, not only may the present invention be applied to equipment for construction use but also it may be applied to hydraulic working equipment used in any kind of work.

Third Embodiment

Figure 10:
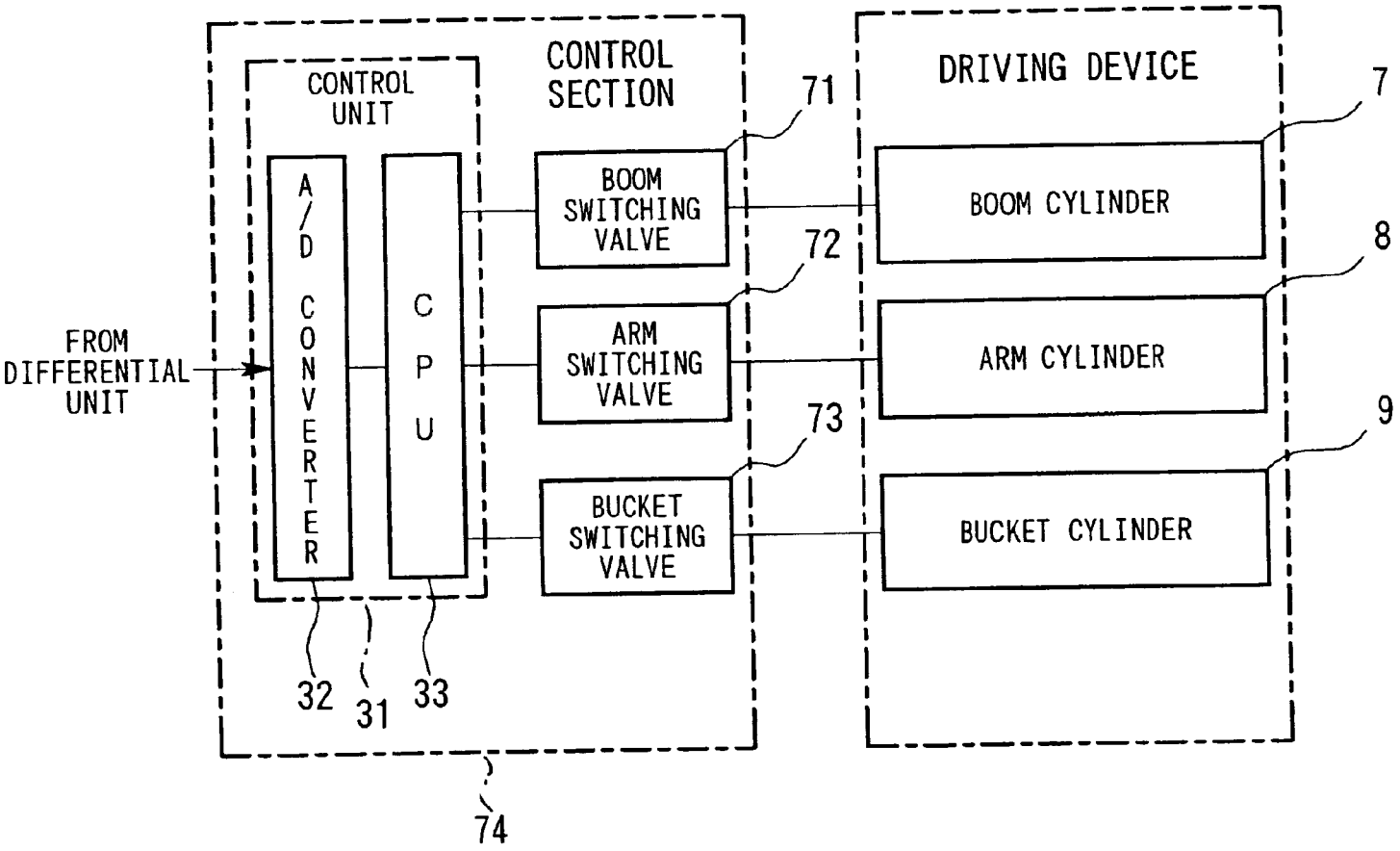
FIG. 10 is a schematic block diagram showing primary portions of the hydraulic excavator in accordance with a third embodiment of the present invention.

Although in the second embodiment, the control valves 25 to 27 composed of the electromagnetic proportional valves are provided in the control section 34, and the switching valves 21 to 23 are controlled by these control valves 25 to 27, as shown in, for example, FIG. 10, the electromagnetic proportional valves may also be used as the switching valves 71 to 73 and the switching valves 71 to 73 may be controlled directly by the signals from the control unit 31. In this case, the control section 74 has the control unit 31 and the switching valves 71 to 73. The other structures are the same as the second embodiment.

Fourth Embodiment

Figure 11:
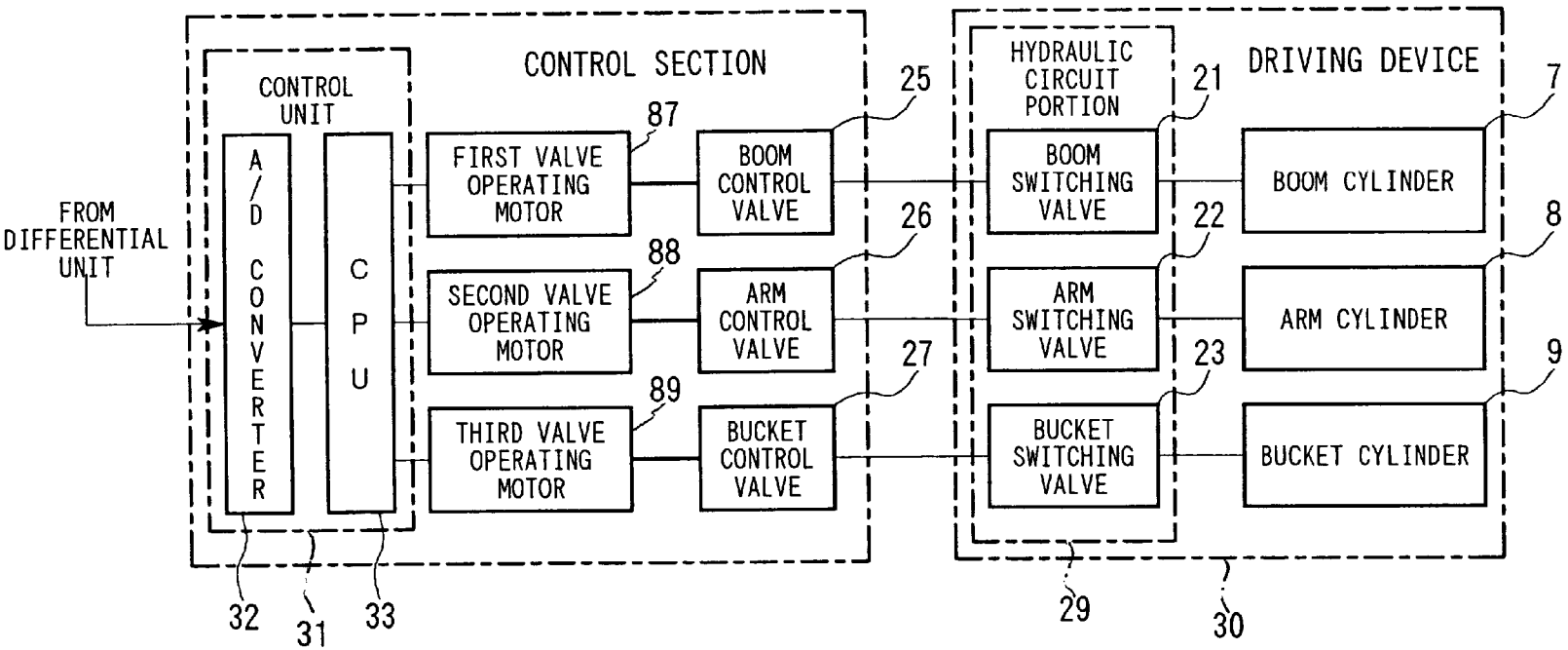
FIG. 11 is a schematic block diagram showing primary portions of the hydraulic excavator in accordance with a fourth embodiment of the present invention.

FIG. 11 is a schematic block diagram showing primary portions of a hydraulic excavator in accordance with a fourth embodiment of the present invention. In the second embodiment, the electromagnetic proportional valves are used as the control valves 25 to 27 and the signals from the control unit are inputted into the control valves 25 to 27. However, as shown in, for example, FIG. 11, it is possible to use control valves 25 to 27 that are mechanically operated, to input the signals from the control unit 31 to the first to third valve operating motors 87 to 89 and to mechanically control the control valves 25 to 27 by these valve operating motors 87 to 89.

Fifth Embodiment

Figure 12:
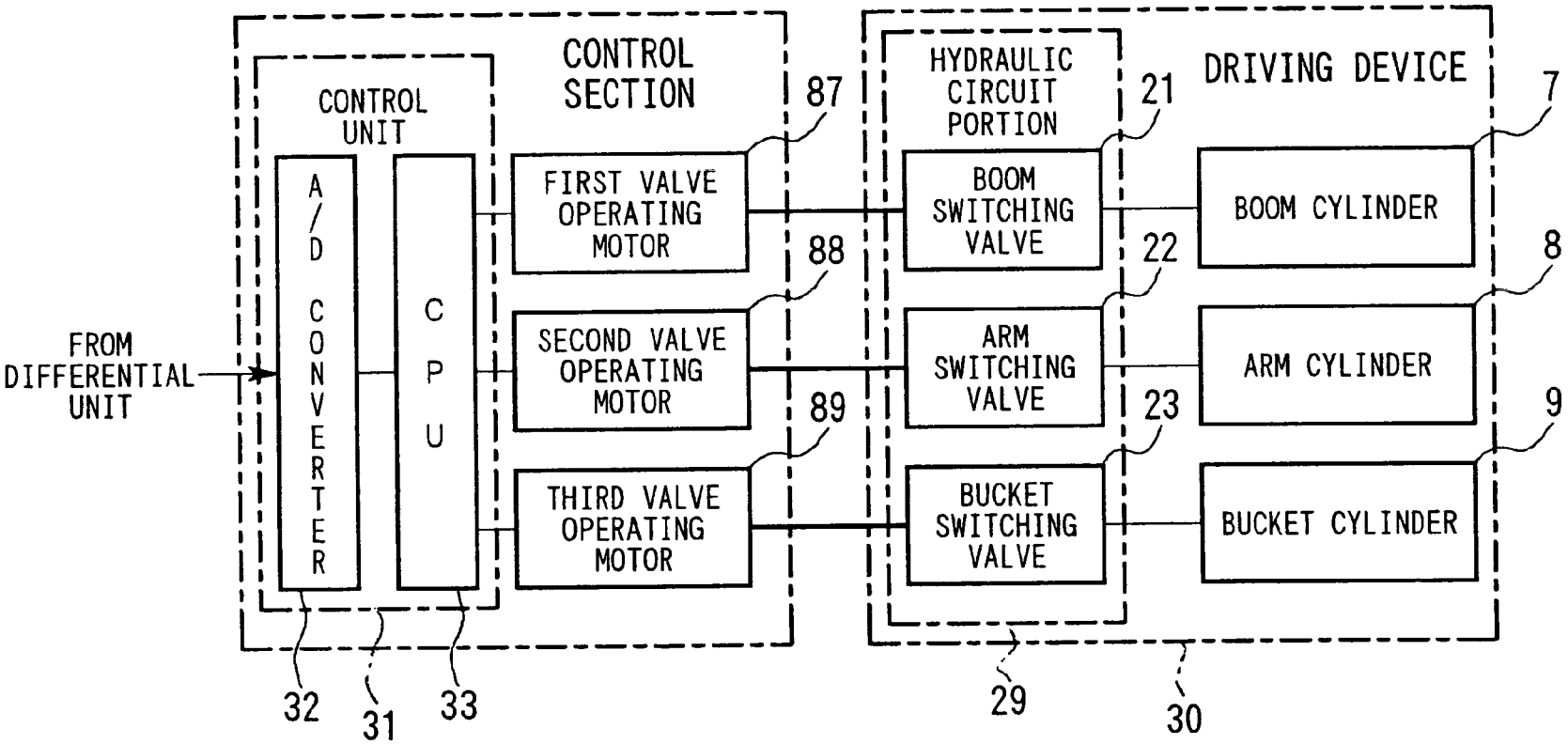
FIG. 12 is a schematic block diagram showing primary portions of the hydraulic excavator in accordance with a fifth embodiment of the present invention.

FIG. 12 is a schematic block diagram showing primary portions of a hydraulic excavator in accordance with a fifth embodiment of the present invention. In the second embodiment, the electromagnetic proportional valves are used as the control valves 25 to 27 and the signals from the control unit 31 are inputted into the control valves 25 to 27. However, as shown in FIG. 12, for example, it is possible to input the signals from the control unit 31 to the first to third valve operating motors 87 to 89 and to directly operate the switching valves 21 to 23 mechanically by these valve operating motors 87 to 89.

Further, in FIGS. 10 to 12, although the description of the pivot motor has been omitted, in the case where the pivot motor is included in the driving device, it is sufficient to control the system in the same manner as in the second embodiment. Also, with respect to the pivot motor, the rotation sensor is provided on the working device side and at the same time, the operating transmitting means is provided to thereby perform the control in the same manner as in the other articulations. In particular, in case of remote operation, it is desirable to perform the control of the pivot motors in the same manner as in the other articulations.

Sixth Embodiment

Figure 13:
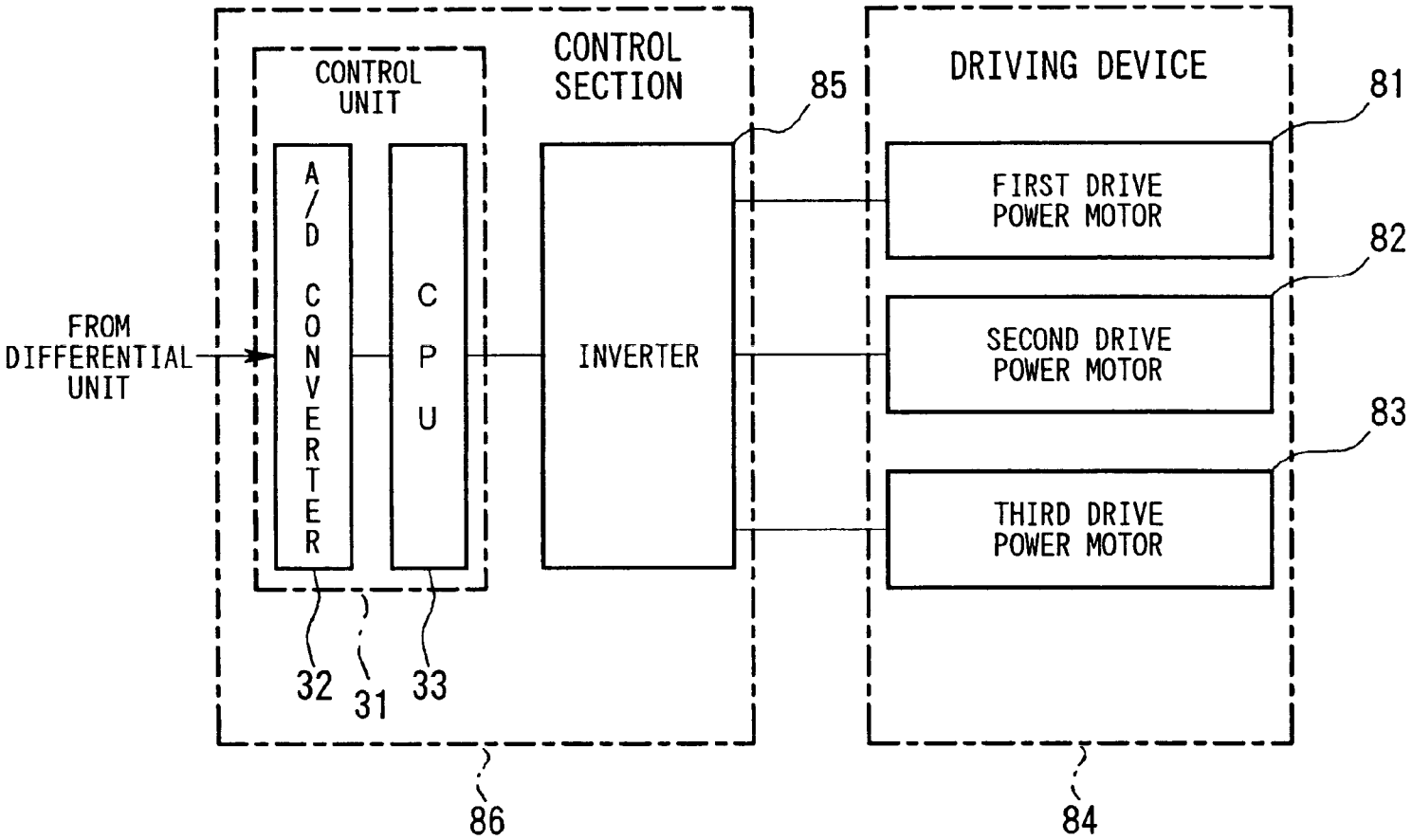
FIG. 13 is a block diagram showing primary portions of electrically powered working equipment in accordance with a sixth embodiment of the present invention.

Next, FIG. 13 is a block diagram showing primary portions of electrically powered working equipment in accordance with a sixth embodiment of the present invention. In this example, the working device (not shown) having a direct link mechanism of three articulations may be used. The three working side link members are rotated by first, second and third drive power motors 81 to 83. The driving device 84 has first, second and third drive power motors 81 to 83.

Also, in the sixth embodiment, it is possible to use the operating device 11 shown in FIG. 8 and the differential unit 15 shown in FIGS. 4 to 7. The rotation of the working side link members is detected by means of the rotation sensors, and the signals from the rotation sensors are inputted into the servomotor 35. The signals from the differential sensor 45 are inputted into the control unit 31. The command signal from the control unit 31 is fed to the first through third drive power motors 81 to 83 through an inverter 85. The control section (control circuit portion) 86 has the control unit 31 and the inverter 85.

With such an arrangement, it is possible to smoothly operate the link mechanism of the working device to follow the link mechanism of the operating device 11, even with respect to the electrically powered working equipment, thereby considerably enhancing operability with a simple structure. It is thus possible to apply the present invention to master/slave type working equipment, which may be used in any field, such as medical treatment devices (such as where a laser projection head, an endoscope or a radiation exposure device is mounted on the working side link member at the end position), working equipment in space, and working equipment for environments toxic to humans such as radiation.

Further, in the case where the present invention is applied to hydraulic heavy equipment, in many cases, an operating device having a size smaller than that of the working device is used. However, in the case where this invention is applied to the working equipment in other fields, it is possible to use operating devices smaller than the working device or operating devices having the same size as the working device.

As described above, the number of articulations of the link mechanism of the working device and operating device are not specifically limited. Inversely, it is possible to realize fine movement of the working device by increasing the number of articulations while applying this invention to a system.

What is claimed is:

1. Working equipment comprising:

a working device having a plurality of rotatably coupled working side link members;

a driving device for rotating said plurality of working side link members, respectively;

an operating device having a plurality of operating side link members rotatably coupled and corresponding to said working side link members, respectively;

a rotation sensor for detecting rotation of said working side link members;

a motor driven in response to a signal from said rotation sensor;

a differential detecting portion having a working side movable portion driven both in a forward direction and a reverse direction by said motor, an operating side movable portion that is shiftable both in the forward direction and the reverse direction within a range from a neutral position to said working side movable portion, and a differential sensor for detecting a relative shift from the neutral position of said operating side movable portion to said working side movable portion;

operation transmitting means disposed between said operating side link members and said operating side movable portion for mechanically transmitting rotation of said operating side link members and for shifting said operating side movable portion in response to the rotation of said operating side link members; and a control section for controlling said driving device in response to a signal from said differential sensor, wherein said working side link members are rotated by said driving device in response to the rotation of the corresponding operating side link members and said working side movable portion is driven by said motor in a direction in which said operating side movable portion is returned to a neutral position.

2. Working equipment according to claim 1, including a return spring for biasing said operating side movable portion to the neutral position, disposed between said working side movable portion and said operating side movable portion.

3. Working equipment according to claim 1, wherein said motor includes a servomotor having a motor body and a rotary shaft rotated by said motor body, said working side movable portion includes a working side rotational piece rotated by the rotation of said rotary shaft, said operating side movable portion includes an operating side rotational piece combined with said working side rotational piece and rotatable within an angular range about an axis common with said working side rotational piece, and said differential sensor detects rotation of said operating side rotational piece relative to said working side rotational piece.

4. Working equipment according to claim 1, wherein said driving device has a hydraulic cylinder for rotating said working side link members and a hydraulic circuit portion including a switching valve for switching operational direction of said hydraulic cylinder, and said control section has a control valve for controlling said switching valve in response to the signal from said differential sensor.

5. Working equipment according to claim 4, wherein said control valve includes an electromagnetic proportional valve.

6. Working equipment according to claim 4, wherein said control section includes a valve operating motor for mechanically operating said control valve in response to the signal from said differential sensor.

7. The working equipment according to claim 1, wherein said driving device has a hydraulic cylinder for rotating said working side link members, and said control section has a switching valve for controlling said hydraulic cylinder in response to the signal from said differential sensor.

8. Working equipment according to claim 7, wherein said switching valve includes an electromagnetic proportional valve.

9. Working equipment according to claim 1, wherein said driving device has a hydraulic cylinder for rotating said working side link members and a hydraulic circuit portion including a switching valve for switching an operational direction of said hydraulic cylinder, and said control section has a valve operating motor for mechanically operating said switching valve in response to the signal from said differential sensor.

10. Working equipment according to claim 1, wherein said driving device has a drive power motor for rotating said working side link members, and said control section controls said drive power motor in response to the signal from said differential sensor.

11. Working equipment according to claim 10, wherein said control section includes an inverter for driving said drive power motor.

12. An operating system for working equipment including a working device having a plurality of rotatably coupled working side link members and a driving device for rotating said plurality of working side link members, respectively, said system comprising:

an operating device having a plurality of operating side link members rotatably coupled and corresponding to the working side link members, respectively;

a rotation sensor for detecting rotation of the working side link members;

a motor driven in response to a signal from said rotation sensor;

a differential detecting portion having a working side movable portion driven both in a forward direction and a reverse direction by said motor, an operating side movable portion that is shiftable both in the forward direction and the reverse direction within a range from a neutral position to said working side movable portion, and a differential sensor for detecting a relative shift from the neutral position of said operating side movable portion to said working side movable portion;

operation transmitting means disposed between said operating side link members and said operating side movable portion for mechanically transmitting rotation of said operating side link members and for shifting said operating side movable portion in response to the rotation of said operating side link members; and a control section for controlling said driving device in response to a signal from said differential sensor, wherein said working side movable portion is driven by said motor in a direction in which said operating side movable portion is returned to a neutral position.

13. The operating system for the working equipment according to claim 12, including a return spring for biasing said operating side movable portion to the neutral position, disposed between said working side movable portion and said operating side movable portion.

14. The operating system for the working equipment according to claim 12, wherein said motor includes a servomotor having a motor body and a rotary shaft rotated by said motor body, said working side movable portion includes a working side rotational piece rotated by rotation of said rotary shaft, said operating side movable portion includes an operating side rotational piece combined with said working side rotational piece and rotatable within an angular range about an axis common with said working side rotational piece, and said differential sensor detects rotation of said operating side rotational piece relative to said working side rotational piece.

15. The operating system for the working equipment according to claim 14, including an arcuate engagement groove in one of said working side rotational piece and said operating side rotational piece, an engagement projection inserted into the engagement groove for moving within the engagement groove in accordance with the relative rotation of said operating side rotational piece, an arcuate spring receiving portion in part of the engagement groove for receiving a return spring for biasing said operating side rotational piece toward the neutral position, and a pair of contact portions in said engagement portion contacting end portions of said return spring.

* * * * *